US005682006A

United States Patent [19]

Perry et al.

[11] Patent Number: 5,682,006

[45] Date of Patent: Oct. 28, 1997

[54] GUN SALVO SCHEDULER

[75] Inventors: John Stephen Perry, Hastings; Stephen E. Ross, Minneapolis, both of Minn.

[73] Assignee: FMC Corp., Chicago, Ill.

[21] Appl. No.: 588,975

[22] Filed: Jan. 19, 1996

Related U.S. Application Data

[63] Continuation of Ser. No. 270,971, Jul. 5, 1994, abandoned.

[51] Int. Cl.[6] ..... F41G 3/00

[52] U.S. Cl. ..... 89/41.01; 89/41.03; 89/41.07; 342/67; 364/423

[58] Field of Search ..... 89/41.01, 41.03, 89/41.07; 342/67; 364/423

[56] References Cited

U.S. PATENT DOCUMENTS

| | | | |
|---|---|---|---|
| 3,836,968 | 9/1974 | Schillreff | 89/41.07 |
| 3,974,740 | 8/1976 | Billottet et al. | 89/41.07 |
| 4,005,415 | 1/1977 | Kossiakoff et al. | 342/67 |
| 4,449,041 | 5/1984 | Girard | 364/423 |
| 4,579,035 | 4/1986 | Whiting | 89/41.07 |
| 4,712,181 | 12/1987 | Dahlberg | 364/423 |
| 4,797,839 | 1/1989 | Powell | 364/423 |
| 5,129,307 | 7/1992 | Cain et al. | 89/41.14 |

FOREIGN PATENT DOCUMENTS

| | | | |
|---|---|---|---|
| 204598 | 9/1991 | Japan | 364/423 |

*Primary Examiner*—J. Woodrow Eldred

[57] ABSTRACT

This disclosure relates to a computer based eminent and dormant threat acquisition, assessment and defense system. Threats are classified as to eminence and incidence of detection and rounds are optimally scheduled to defeat the threats based on inventory of defensive rounds, response time and probability of kill.

11 Claims, 3 Drawing Sheets

GUN SALVO SCHEDULER

This is a continuation of application 08/270,971, filed Jul. 5, 1994, now abandoned.

FIELD OF THE INVENTION

The present invention deals with burst size optimization for any projectile-based system designed to defeat multiple targets presenting eminent threats. An optimum probability of defeating the threats is achieved by scheduling the number of rounds needed to kill each target. The invention utilizes logic steps and routines which are integrated with fire control computers, target acquisition radar and communication systems to enable assessment of eminent threats and assign responsive measures to defeat the threats.

SUMMARY OF THE INVENTION

The gun salvo scheduler is a computer based target information acquisition, threat assessment and appropriate response initiating system which maximizes a cumulative probability of kill against the target and schedules rounds accordingly. The salvo scheduler utilizes a closed looped routine to schedule rounds so that the predicted probability of kill is maximized. The routine, iteratively, compares the preferred threshold of probability of kill and adjusts it based on availability of rounds and limitations of response time. Specific advances, features and advantages of the present invention will become apparent upon examination of the following description and drawings dealing with several specific embodiments thereof.

BRIEF DESCRIPTION OF THE DRAWINGS

1.

2.

4.

DESCRIPTION OF THE PREFERRED EMBODIMENT

The present invention provides a computer integrated algorithm which maximizes the likelihood of surviving a missile/aircraft attack against a high value asset defended by a gun weapon system.

Figure 1:
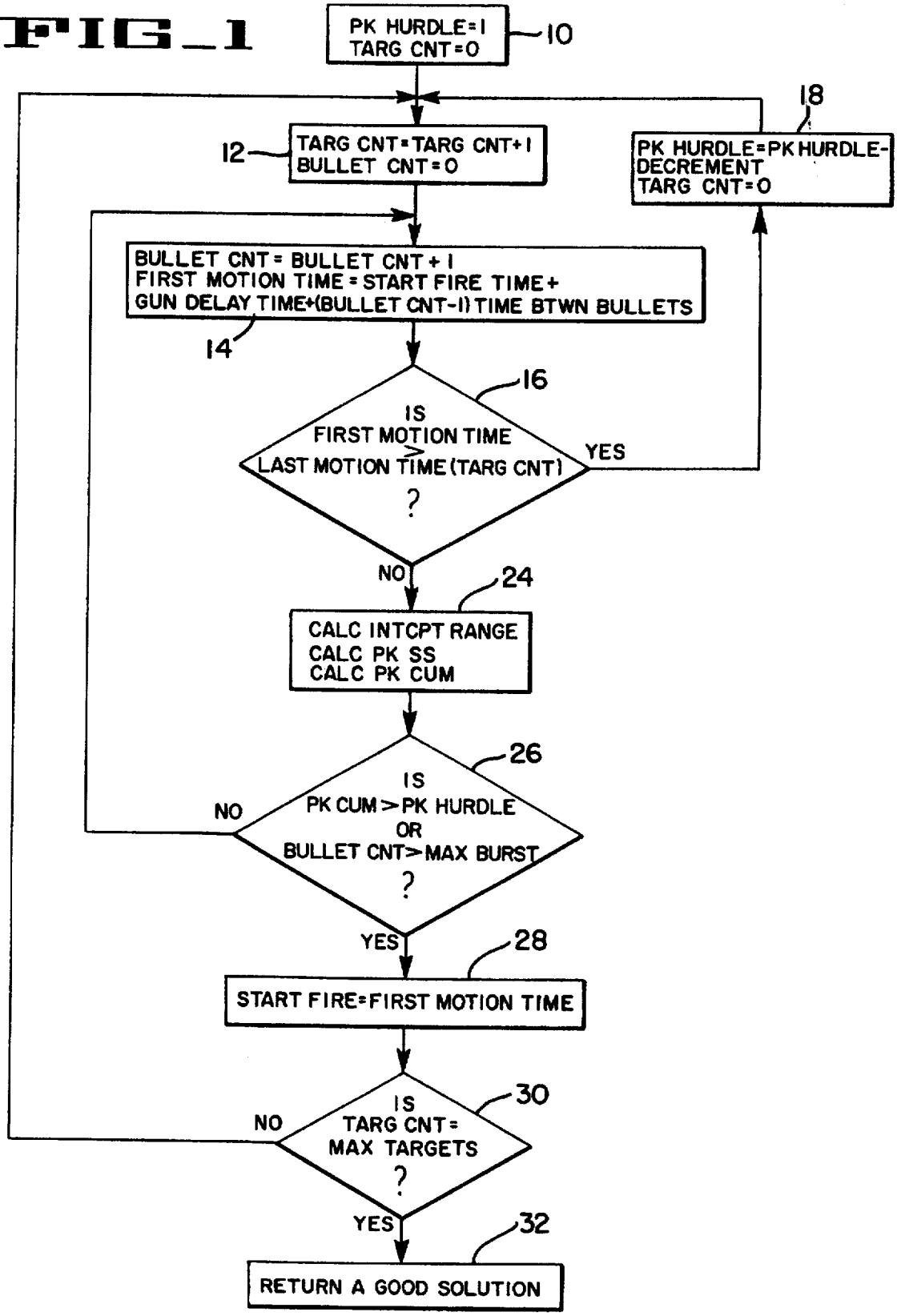
FIG. 1 is a flow chart in which the routine assesses the population of the threat; the availability of rounds; the fire rate or time between rounds; the probability of killing the threat and determines the best solution, by determining the number of rounds to fire at each target.

Referring now to FIG. 1, a flow chart is shown in which algorithmic logic steps are set. Probability of kill (PK) and target count (TARG CNT) 10 initiates the target counter and subsequent logic steps and routines. Initially the target count is set at zero. This communicates with the Bullet and Target count logic step 12. The bullet count is set at zero, initially. Consecutive logic step 14 sets bullet count, first motion time and gun delay time. Further, logic step 14 sets first motion time equal to the sum of start fire, gun delay time and time between bullets. Logic step 16 compares and confirms if first motion time is greater than last motion time or target count. If the response to logic step 16 is affirmative, the routine advances to logic step 18 which decreases the desired PK hurdle by an established quantity. The target count is set to zero and when the probability of kill is equal to unity, the result is directed back into logic step 12. If the answer to logic step 16 is in the negative, the routine proceeds to logic step 24. Logic step 24 includes intercept range calculations; probability of kill for a single shot (SS) calculations as well as calculations for cumulative probability of kill. Consecutive logic step 26 inquires if the cumulative probability of kill is greater than the probability of hurdle or if the bullet count is greater than the maximum burst size allowable. If the answer to any of these is negative the logic routine reverts behind logic step 14. If the answer is positive the routine proceeds to logic step 28 to set the start fire time which is equal to first motion time. Subsequently, the routine advances to logic step 30 wherein the system checks if the target count is equal to the maximum targets observed. If the target count does not yield the maximum number of targets, the logic reverts back to logic step 12. On the other hand, if the target count yields the maximum number of threat targets, the routine advances to logic step 32 wherein the system returns the number of bullets to fire at each threat. Logic steps 10 through 32 discussed hereinabove, comprise the logical sequence and steps required to set up probability of kill and eminent threat target count. In subsequent discussions, as in FIG. 2, logic steps 10 through 32 will be referred to as "Routine A" 56.

Figure 2:
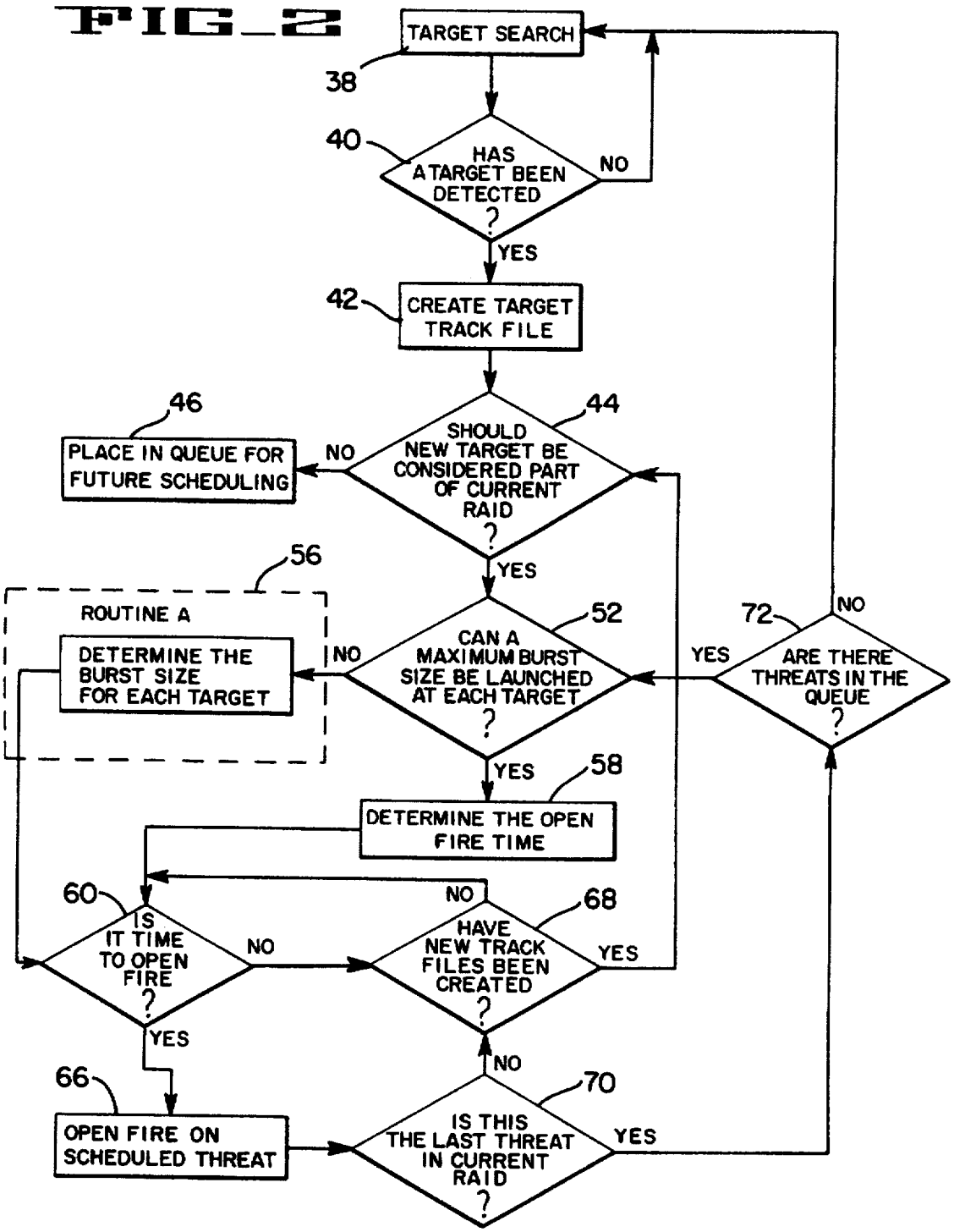
FIG. 2 is a flow chart showing how the optimal burst routine fits in with the other functions in a fire control computer to detect, track, queue, schedule, and engage incoming targets 3.

Referring now to logic steps of FIG. 2, the unique aspects of Routine A 56 are shown integrated with other logic as shown. More specifically, logic step 38 sets the target search. Consecutive logic step 40 interrogates if a target has been detected. If no target detection has been noted the routine is directed back to target search logic step 38. However, if a target has been detected the routine is directed to logic step 42 wherein a target track file is created. The routine proceeds to logic step 44 which determines whether the new target should be considered part of the current raid. If the new target is not part of the current raid, it is placed in a queue for future scheduling and is set under logic step 46. If a new target is considered part of the current raid the routine proceeds to logic step 52 to decide if a maximum burst size could be launched at each target. If a maximum burst size could not be launched at each target the system reverts to Routine A 56 (See FIG. 1) and accordingly, the burst size for each target is determined. In the alternate, if a maximum burst size could be launched at each target, the system proceeds to logic step 58 where the open fire time is determined. Consecutive logic step 60 determines the time to open fire. Upon confirming to open fire the routine proceeds to logic step 66 where fire is opened on the scheduled threat. If the time is not ripe to open fire the routine proceeds to logic step 68 which checks if new track files have been created. In the absence of new track files the routine reverts back to logic step 60 as shown. Further, it should be noted that logic step 60 is communicative with Routine A 56, such that the burst size for each target is determined simultaneously with the proposal to whether it is time to open fire. Logic step 66 advances to logic step 70 where the current raid is checked to be the last threat in the current raid. If the response is negative, the routine goes back to logic step 68. In the alternate, if the response is positive, the routine advances to logic step 72 where the existence of threats in the queue is checked. If there are threats in the queue, the routine advances to logic step 52. On the other hand, if there are no threats in the queue, the routine goes back to logic step 38 where a target search and consecutive logic are initiated.

Figure 3:
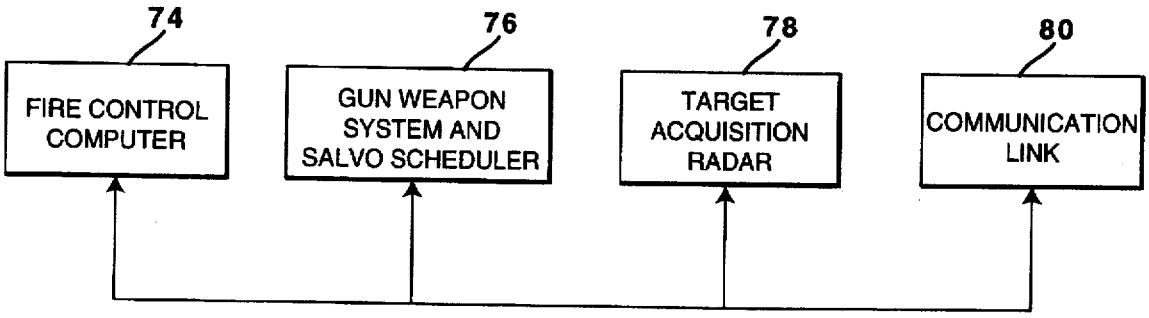
FIG. 3 is a block diagram showing the interaction of the salvo scheduler with other units and the communication thereof.

Referring now to FIG. 3, a communicative system comprising fire control computer 74, gun weapon system and salvo scheduler 76, target acquisition radar 78 and communication link 80 are shown.

Figure 4:
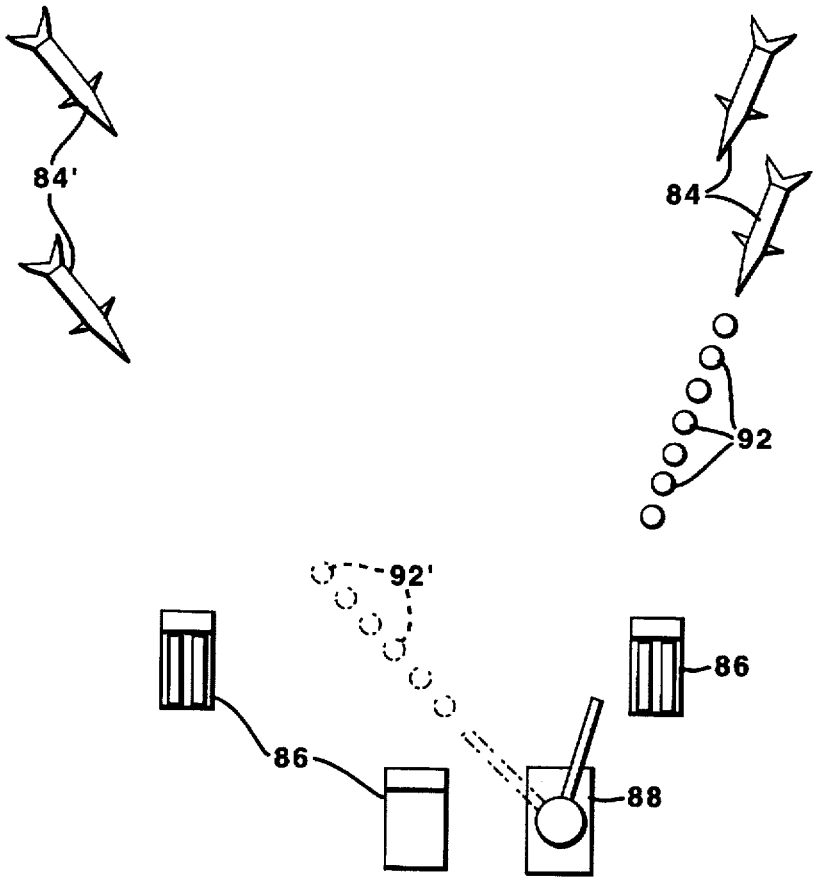
FIG. 4 is a depiction of how the salvo scheduler protects assets by attacking in-coming threats.

FIG. 4 shows the general and conceptual operation of the present invention. In-coming threats or missiles 84 and 84' are shown directed at assets 86. Gun system 88, fires rounds 92 and 92', using the salvo scheduler of the present invention to defeat the incoming threats.

The description hereinabove relates to some of the most important features which set and determine, inter alia, the structural parameters of the present invention. The operations of the present invention, under a best mode scenario, are discussed hereinbelow.

As disclosed in the logic flow chart of FIG. 1, (Routine A) one of the most important aspects of the present invention includes the ability to set and calculate the burst size directed to each threat thereby maximizing probability of eliminating all threats. Primarily, target acquisition radar 78 provides input to gun weapon system and salvo scheduler 76 that a threat target has been identified. With specific reference to FIGS. 2 and 3, target search in logic step 38 communicates with target acquisition radar 78 via communication link 80. Once the presence of a target is confirmed, a target track file is created under logic step 42. Further, the target is classified as either a part of the current raid or a non-current raid target under logic step 44. If the new target is not part of the current raid, the data is placed in queue for future scheduling under logic step 46. The routine proceeds to allocate a maximum burst size per target if the threat is identified as part of the current threat. This is executed under logic step 52. However, if the maximum burst size cannot be launched at each target, the logic flow advances to Routine A, logic step 56, to determine the burst size required to defeat each target. Further, gun weapon system and salvo scheduler 76 communicate with fire control computer 74 to determine the open fire time 58. Thence, the routine proceeds to logic step 60 to confirm if it is time to open fire. If the system's readiness to open fire is confirmed, fire is opened on the scheduled threat, under logic step 66. Further, for every threat being fired upon, the routine confirms if this is the last threat in the current raid under logic step 70. When the last of the current threats is confirmed, the routine proceeds to check if there are any threats in the queue under logic step 72. Continuous communications with target acquisition radar 78 provide information on both queued and current threat data. If the last of the current threats is dealt with, and there are no threats resident in the queue, the routine goes back to logic step 38 to search for new targets.

Referring now to FIGS. 3 and 4, the overall system function is represented. Here, gun weapon system and salvo scheduler 76 is incorporated in gun system 88. Further, fire control computer 74 is also incorporated in gun system 88. Gun system 88 communicates with target acquisition radar 78 via communication link 80. In-coming threats 84 are detected by radar 78 and the information is communicated to salvo scheduler 76 in gun system 88. The salvo scheduler 76 goes through the iteration and logic steps disclosed in FIGS. 1 and 2 and discussed hereinabove. The salvo scheduler 76 of the present invention commands the fire control against the scheduled threat and rounds 92 are deployed to engage threats 84. More specifically, the salvo scheduler of the present invention prioritizes threats according to most eminent threat arrival. Thus, the gun system engages threats 84 first. A specific number (burst size) of rounds 92 are allocated and deployed to destroy the eminent threats 84. Further, gun system 88 switches over to in-coming threats 84' (refer to phantom lines) to engage these threats on a second priority or temporally sequenced basis. Thus, the salvo scheduler determines the open fire time and allocates the optimum number of rounds to defeat a threat. More specifically, the present invention enables the optimization of probability of kill based on threat characteristics. Accordingly, the protection of assets 86 is significantly enhanced by the unique features and functions resident in the present invention.

While a preferred embodiment of the gun salvo scheduler has been shown and described, it will be appreciated that various changes and modifications may be made therein without departing from the spirit of the invention as defined by the scope of the appended claims.

What is claimed is:

1. A software implemented computer system for salvo scheduling and optimizing device to defeat multiple threats, the device comprising:

a gun weapon system with a fire control system;

the software implemented computer system in operative and electronic communication with said fire control system;

means for optimally scheduling rounds to engage multiple unfriendly targets wherein said means for optimally scheduling comprising: means for analyzing probability of kill;

means for counting the number of rounds to be fired at each target;

means for continuously searching for targets;

means for scheduling a burst size for each detected target;

means for opening fire on a scheduled target;

means for confirming a last threat in a current raid;

means for acquiring, tracking and queuing said multiple unfriendly targets wherein said means for queuing is implemented for future scheduling when a new target is found to type not a part of a current raid; and means for communicating between said gun weapon system with a fire control system, the software implemented computer system, said means for optimally scheduling rounds, said means for counting the number of rounds to be fired at each target, and said means for acquiring, tracking and queuing said multiple unfriendly targets.

2. The device according to claim 1 wherein said fire control system is operated by the software implemented computer system and the software implemented computer system includes means for monitoring a time to open fire and a time to terminate fire further that said monitoring means including means for determining a burst size for each target simultaneously with a proposal to whether it is time to open fire.

3. The device according to claim 1 wherein the software implemented computer system is directed by the software and the software includes means for prioritizing threats according to most eminent threat arrival.

4. The device according to claim 1 wherein said means for communicating includes a common link network between said fire control system, said means for scheduling rounds, and said means for acquiring, tracking and queuing said multiple unfriendly targets when multiple targets are in-bound and said software implemented computer system includes means for optimizing probability of kill against unfriendly targets based on the unfriendly target characteristics.

5. The device according to claim 1 wherein said means for communicating includes a common link network between said fire control system, said means for scheduling rounds, said means for acquiring, tracking and queuing said multiple unfriendly targets when multiple targets are in-bound and said software implemented computer system.

6. A system for optimizing salvo in a gun system in cooperation with a fire control integrated with a software implemented computer system to engage and kill current incoming multiple threats and targets comprising:

means for detecting and tracking the multiple threats;

means for prioritizing and queuing the multiple threats according to time of arrival wherein said means for queuing is implemented for future scheduling when a new target is found to be not a part of said current incoming multiple threats: and at least one communication link between the fire control integrated with said software implemented computer system, the gun system, said means for scheduling and optimizing single bursts of salvo burst size, said means for detecting and tracking threats and said means for positioning and queuing threats.

7. The system according to claim 6 wherein said means for optimizing salvo includes a routine within said computer system providing means which iteratively compares the preferred threshold of probability of kill for a given target, adjusts availability of rounds for single burst firings in cooperation with said means for counting the number of rounds that should be fired at each target and provides means for optimizing probability of kill against said threats based on characteristics of the threats.

8. The system according to claim 6 wherein said means for detecting and tracking threats includes a target acquisition radar system integrated with said means for counting the number of rounds to be fired at each target and said software implemented computer system.

9. A method of optimizing salvo in a gun system to engage multiplethreats including a software implemented fire control computer system in cooperation with a gun weapon system, target acquisition radar and a communication link forming a gun salvo scheduler wherein the method includes the software implemented steps of:

searching targets:

confirming detection of targets;

creating a track file for the targets;

identifying the targets as one of new raid and one of current raid;

placing in a queue for future scheduling if the targets are identified as one of said new raid;

calculating maximum burst size to launch at each of one of said current raid targets;

determining time to open fire;

confirming if it is time to open fire;

opening fire on the targets for which there is a scheduled fire;

confirming a last target among the targets in said current raid;

confirming if there are targets in said queue; and returning back to searching targets to start over.

10. The method according to claim 9 wherein said method of determining the burst size for each target includes a subroutine of said software including the software implemented steps of:

calculating probability of kill while setting a count for said targets equal to zero;

increasing target count by unity to get a latest target count while setting bullet count equal to zero;

increasing bullet count by unity to get a latest bullet count;

setting first motion time equal to start fire time plus gun delay time plus a product of said latest bullet count and time between bullets:

deciding if first motion time is greater than last motion time;

deciding to set target count to zero if said first motion time is greater than said last motion time;

deciding to calculate intercept range, probability of kill and cumulative probability of kill if said first motion time is not greater than last motion time;

deciding to start fire if said cumulative probability of kill is greater than probability of kill hurdle;

deciding to start fire if bullet count is greater than maximum burst:

setting said subroutine back to said bullet count if said cumulative probability of kill is smaller than said probability of kill hurdle and further if said bullet count is smaller than said maximum burst;

setting said start fire routine equal to said first motion time;

comparing said target count with a maximum target to confirm if all targets were killed; and returning back to said step of increasing target count by unity to repeat said method.

11. A software implemented fire control computer including a gun weapon system and a salvo scheduler, target acquisition radar and a communication link forming a gun salvo scheduler said software implemented fire control computer comprising:

means for searching targets;

means for confirming detection of targets;

means for creating a track file for the targets;

means for identifying the targets as one of new raid and one of current raid;

means for placing in a queue for future scheduling if the targets are identified as one of said new raid;

means for calculating maximum burst size to launch at each of one of said current raid targets;

means for determining time to open fire;

means for confirming if it is time to open fire;

means for opening fire on the targets for which there is a scheduled fire;

means for confirming a last target among the targets in said current raid;

means for confirming if there are targets in said queue; and means for returning back to searching targets to start over.

* * * * *